US007837060B2

(12) United States Patent
Mullett et al.

(10) Patent No.: US 7,837,060 B2
(45) Date of Patent: Nov. 23, 2010

(54) PORTABLE SANITARY DISPENSER ASSEMBLY

(75) Inventors: Rodney M. Mullett, Hammond, IN (US); Vaughan D. Smith, II, Markham, IL (US); Jamie P. Kostelyk, Hammond, IN (US)

(73) Assignee: PolyJohn Enterprises Corporation, Whiting, IN (US)

( * ) Notice: Subject to any disclaimer, the term of this patent is extended or adjusted under 35 U.S.C. 154(b) by 705 days.

(21) Appl. No.: 11/671,705

(22) Filed: Feb. 6, 2007

(65) Prior Publication Data

US 2008/0185393 A1 Aug. 7, 2008

(51) Int. Cl.
*B65G 59/06* (2006.01)

(52) U.S. Cl. ..... 221/132; 221/120; 221/124; 221/92; 221/96; 221/97

(58) Field of Classification Search ..... 221/96, 221/132, 120, 124, 92, 97
See application file for complete search history.

(56) References Cited

U.S. PATENT DOCUMENTS 1,734,045 A * 11/1929 Parran ..... 221/150 HC
4,143,792 A 3/1979 Rex
4,663,943 A * 5/1987 Dyment et al. ..... 62/250
D317,383 S * 6/1991 Brill et al. ..... D6/455
5,244,220 A 9/1993 Cortez
5,346,064 A 9/1994 Rizzuto
5,397,019 A * 3/1995 Schmitt ..... 221/130
5,502,848 A 4/1996 Cowan
5,868,346 A 2/1999 Cobos
6,170,692 B1 1/2001 Johnston
6,189,730 B1 2/2001 McClymonds
6,318,627 B1 11/2001 Koebbe
6,691,897 B2 * 2/2004 Ashe ..... 222/174
6,905,039 B2 6/2005 Richter et al.
6,988,691 B1 1/2006 Lai
7,051,899 B1 * 5/2006 Offenhauer et al. ..... 221/124

OTHER PUBLICATIONS 2 color pictures of Amason's hand towel dispenser. Applicants believe that the disclosed Amason's hand towel dispenser was in public use before the filing of the present application.

* cited by examiner

*Primary Examiner*—Gene Crawford
*Assistant Examiner*—Michael K Collins
(74) *Attorney, Agent, or Firm*—Harness, Dickey & Pierce, P.L.C.

(57) ABSTRACT

A standalone portable dispenser assembly for sanitary items includes a base portion that provides resistance to the dispenser assembly against being tipped from an upright condition, an extension portion extending upwardly from the base portion, an upper cover portion attached to the extension portion above the base portion and a dispensing unit below the upper cover portion. One or more dispensing devices are disposed upon or within the dispensing unit for dispensing at least one sanitary item, such as hand towels and liquid hand soaps. The dispensing unit is at least partially shielded from weather by the upper cover portion, and the assembly is provided in a modular configuration for the convenient replacement of damaged components.

27 Claims, 6 Drawing Sheets

PORTABLE SANITARY DISPENSER ASSEMBLY

FIELD

The present disclosure relates generally to portable sanitary dispensers, and more specifically to a standalone portable dispenser assembly having multiple locations for holding a plurality of individual dispenser units for sanitary items such as hand towels and hand soap.

BACKGROUND

The statements in this section merely provide background information related to the present disclosure and may not constitute prior art.

It is often desirable in various types of environments to have sanitary items such as disposable hand towels and hand soap available for activities such as cleaning one's hands. Such environments may include outdoor public settings such as parks, festivals, golf courses and sporting events, as well as indoor public settings such as grocery stores, trade shows and malls. In many of these locations, people may have the need to clean their hands after food has been served, or where their hands may become dirty for any reason. Oftentimes, conventional restroom facilities that would ordinarily provide ready accessibility to hand towels and/or hand soap are either not present or are inconvenient to visit.

In addition, the need for sanitary items often occurs on a temporary basis, such as when festivals are set up at particular locations for limited periods of time, or when grocery stores or other businesses set up temporary locations for providing food samples to customers. Accordingly, in these settings, it is often desirable to provide selected sanitary items, such as disposable hand towels, on a similar temporary basis for allowing the cleaning of hands. There is thus a need for portable sanitary item dispensers of the type that can be easily and conveniently moved into a desired location, and subsequently removed when no longer needed. Such dispensers should preferably be of a size and weight suitable for being hand-portable, capable of holding a sufficient number of hand towels, a sufficient amount of hand soap or a sufficient amount of any other desired sanitary item, for frequent use by many individuals. They should also preferably be conveniently transported, refilled and stored.

Certain types of sanitary items are commercially available in pre-manufactured and/or refillable dispensing devices, or containers, for ready retrieval. It is economical, and therefore desirable, to provide dispensers of the type that can readily accommodate these types of dispensing devices in some way. Examples of such dispensing devices include pre-manufactured hand towel canisters and refillable hand soap containers, which would be attached to or contained within the portable sanitary item dispensers.

Because such portable sanitary dispensers are likely be used by many individuals, it is convenient, and therefore desirable, to make the dispensers accessible from all sides and at a height convenient for sanitary activities, such as hand-washing. In addition, because such dispensers would be moved frequently, they would preferably be constructed of a strong, lightweight durable material and assembled in a durable configuration. Such dispensers would also preferably be constructed of weather-resistant materials and in a configuration suitable for maintaining a stationary position in windy outdoor conditions.

Because such dispensers could potentially be subject to vandalism, it would be desirable for them to be constructed in a modular design, so that damaged portions could be easily replaced. Also, in order to protect the contents of such dispensers from theft, it would be desirable for the contents to be secured in a locked condition within the dispensers. It would also be advantageous for the dispensed items to be at least partially protected from the weather by the configuration of the dispenser assembly, such as to prevent dry hand towels from becoming wet due to rain. It would be further advantageous for such dispensers to be constructed from materials and in configurations that allow for convenient cleaning and maintenance when needed.

SUMMARY

Accordingly, there is provided a standalone portable dispenser assembly for sanitary items comprising a base portion having a lower surface suitable for resting upon the ground or other support surface and having a configuration that provides resistance to the dispenser assembly against being tipped from an upright condition; an extension portion attached to, and extending upwardly from, the base portion; an upper cover portion attached to the extension portion so as to be maintained in a position above the base portion; a dispensing unit disposed upon the extension portion so as to be maintained in a position above the base portion while being at least partially shielded from weather by said upper cover portion; and at least one dispensing device disposed in communication with said dispensing unit, each dispensing device operable for dispensing at least one sanitary item.

An object of the present invention is to provide a standalone portable dispenser assembly for sanitary items such as hand towels and hand soap.

An additional object of the present invention is to provide a standalone portable dispenser assembly for sanitary items that is conveniently transported, refilled and stored.

A further object of the present invention is to provide a standalone portable dispenser assembly for sanitary items that can accommodate the attachment or inclusion of pre-manufactured and/or refillable dispensing devices or containers, such as pre-manufactured hand towel canisters and refillable hand soap containers, upon or within the assembly.

Yet another object of the present invention is to provide a standalone portable dispenser assembly for sanitary items that is conveniently accessible from all sides and is located at a convenient height for sanitary activities, such as hand-washing.

An additional object of the present invention is to provide a standalone portable dispenser assembly for sanitary items that is constructed of a strong, lightweight, durable, weather-resistant material and assembled in a durable configuration, so as to be resistant to wear from exposure to weather and damage from repeated storage, use and transportation.

Another object of the present invention is to provide a standalone portable dispenser assembly for sanitary items that is constructed in a removable modular manner, so that damaged portions can be quickly and conveniently removed and replaced.

A further object of the present invention is to provide a standalone portable dispenser assembly for sanitary items in a configuration suitable for maintaining a stationary position in windy outdoor conditions.

An additional object of the present invention is to provide a standalone portable dispenser assembly for sanitary items that provides for the dispensed items to be at least partially protected from the weather by the configuration of the dispenser assembly.

Yet an additional object of the present invention is to provide a standalone portable dispenser assembly for sanitary items that is constructed from materials and in configurations that allow for convenient cleaning and maintenance when needed.

A further object of the present invention is to provide a standalone portable dispenser assembly for sanitary items that is constructed so as to secure the dispensed contents in a lockable manner, so as to protect the contents from theft.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
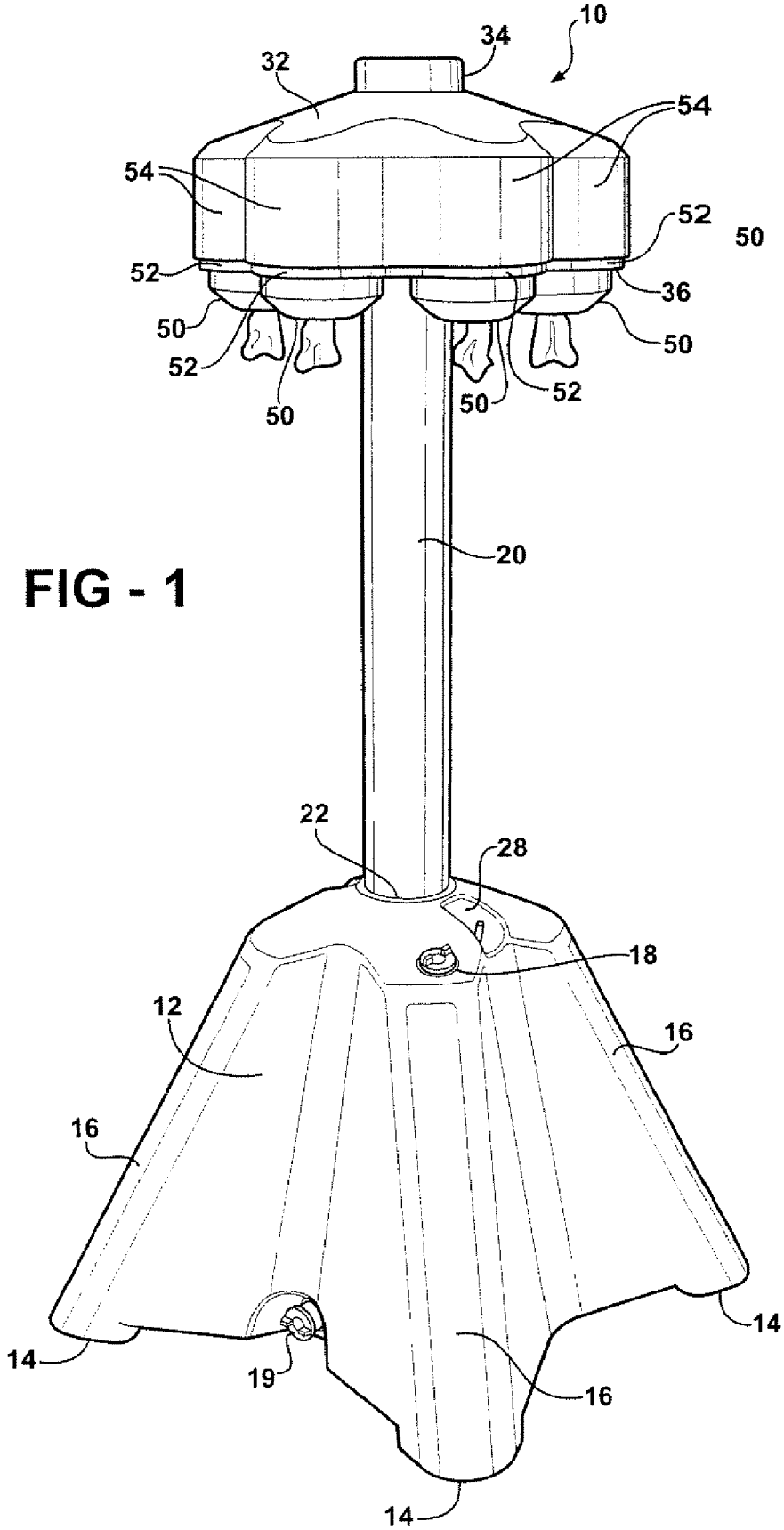
FIG. 1 is a perspective view of the standalone portable dispenser assembly of the present invention, in a configuration including multiple pre-manufactured hand towel dispensing devices.

The following description is merely exemplary in nature and is not intended to limit the present disclosure, application, or uses. It should be understood that throughout the drawings, corresponding reference numerals indicate like or corresponding parts and features.

Figure 2:
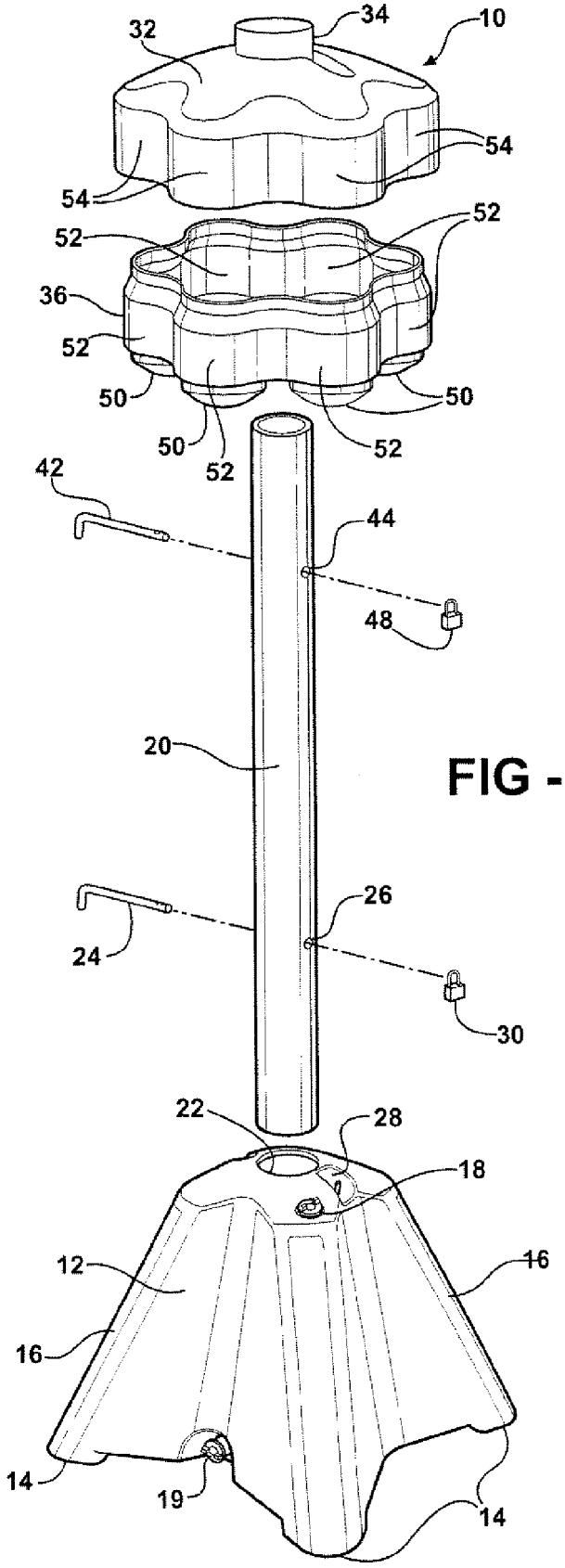
FIG. 2 is an exploded perspective view of the standalone portable dispenser assembly of the present invention, in a configuration suitable for including multiple pre-manufactured hand towel dispensing devices, but with the dispensing devices removed.

Referring to FIGS. 1 and 2, there is shown a standalone portable dispenser assembly of the present invention, generally at 10. The dispenser assembly 10 is shown to include a base portion 12 having a plurality of lower surfaces, or feet, 14 suitable for resting upon the ground or other support surface. It will be appreciated that the base portion 12 may also include a substantially flat integral lower surface. The base portion 12 is configured for maintaining a stationary position in windy outdoor conditions or against being bumped by passersby by including a plurality of leg portions 16 disposed in an outward relation to a central longitudinal axis (not shown) of said base portion 12.

In order to enhance resistance of the dispenser assembly 10 against being tipped from an upright condition, the base portion 12 is optionally constructed to include an internal enclosed space suitable for containing a material for providing weight to said base portion 12. Such material may be sand or water, although other suitable materials may also be used. Accordingly, the base portion 12 is shown to include one or more optional removable closures such as fill plug 18, which can be removed for filling the base portion 12 with a material for providing weight, and subsequently closed to retain the material within the interior of the base portion 12. When weight is no longer required in the base portion 12, one of the closures, such as drain plug 19, is removed and the material contained within the base portion 12 is removed.

The base portion 12 is constructed of a durable, but lightweight, plastic material that is molded into the desired shape. This material has the advantages of being economical, convenient for molding and tinting as desired, easily transported, resistant to denting and other damage during use or transportation, resistant to effects from weather exposure and resistant to damage from vandalism. However, it will be appreciated that other suitable materials may also be used.

The dispenser assembly 10 further includes an extension portion 20 that is attached to, and extending upwardly from, the base portion 12, by being inserted into an aperture 22 of the base portion 12. Preferably, the extension portion 20 is removably attached to the base portion 12, such that the dispenser assembly 10 is in a modular configuration for convenient removal and replacement of components of the assembly, such as for repairing damaged components. The extension portion 20 is shown to be in the form of a vertically-extending elongated tube, although it will be realized that the extension portion 20 may be in other suitable configurations. Again, the extension portion 20 is constructed of molded plastic, although other suitable materials may also be used. The extension portion 20 can also be removed from the base portion 12 to aid in transportation of the assembly components, and also so that the open aperture 22 can provide a larger opening for filling the base portion with water or sand or evacuating a material for providing weight, such as water or sand, from within the base portion 12.

In order to prevent theft or vandalism of the components of the dispenser assembly 10, the extension portion 20 can be capable of being locked to the base portion 12. This is shown in FIG. 2 through the use of a pin 24 that is inserted through apertures 26 and recesses 28 in the extension portion 20 and base portion 12, respectively, and can be locked through the use of a lock 30, such as a conventional keylock.

The dispenser assembly 10 further includes an upper cover portion 32 attached to the extension portion 20 so as to be maintained in a position above the base portion 12. In order to enhance a secure relation between the extension portion 20 and the upper cover portion 32, the upper cover portion 32 includes a cap portion 34 that is sized for the insertion of the extension portion 20 through the interior of the upper cover portion 32 and into the interior of the cap portion 34. Also, the upper cover portion 32 may be permanently attached to the extension portion 20 by the insertion of suitable fasteners, such as rivets (not shown), into the cap portion 34 and the upper end of the inserted extension portion 20. Alternatively, the upper cover portion 32 may be removably attached to the extension portion 20, so as to provide a modular assembly for which one or more portions can be conveniently replaced in the event of damage.

The dispenser assembly 10 also includes a dispensing unit 36 disposed upon the extension portion 20 to provide a location for the inclusion or attachment of one or more dispensing devices. The dispensing unit 36 is located so as to be maintained in a position above the base portion 12 at a height suitable for the convenient retrieval of sanitary items while being at least partially shielded from weather by the upper cover portion 32. Accordingly, the dispensing unit 36 may be secured to a lower surface of the upper cover portion 32, secured within a lower recess of the upper cover portion 32, or inserted through a lower opening of the upper cover portion 32 and secured within said upper cover portion 32, such that a majority of the dispensing unit 36 is contained within the upper cover portion 32.

Figure 3:
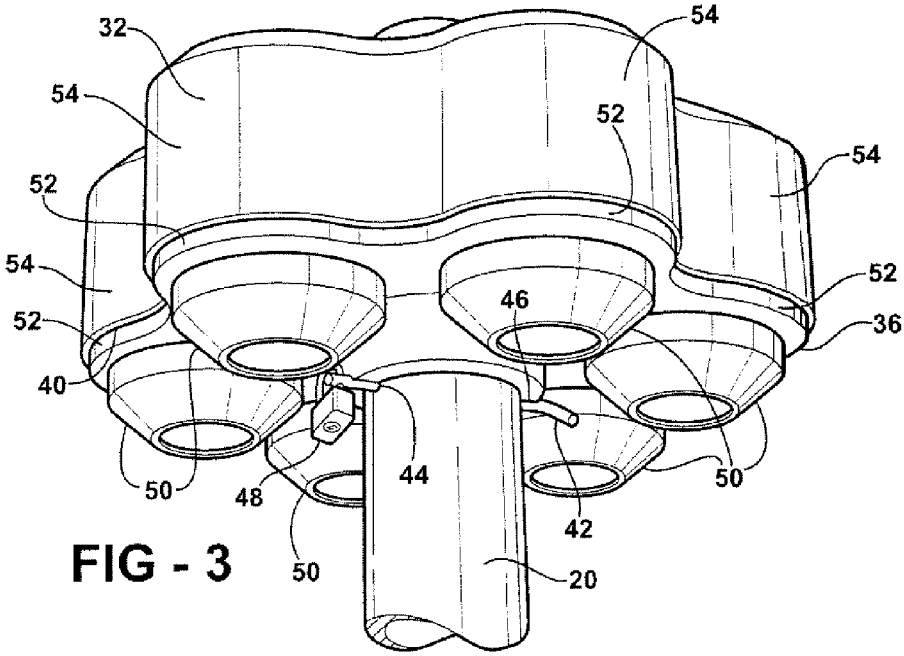
FIG. 3 is a lower perspective view illustrating the upper cover portion and the dispensing unit of the standalone portable dispenser assembly of the present invention in a configuration suitable for including multiple pre-manufactured hand towel dispensing devices, but with the dispensing devices removed.
Figure 4:
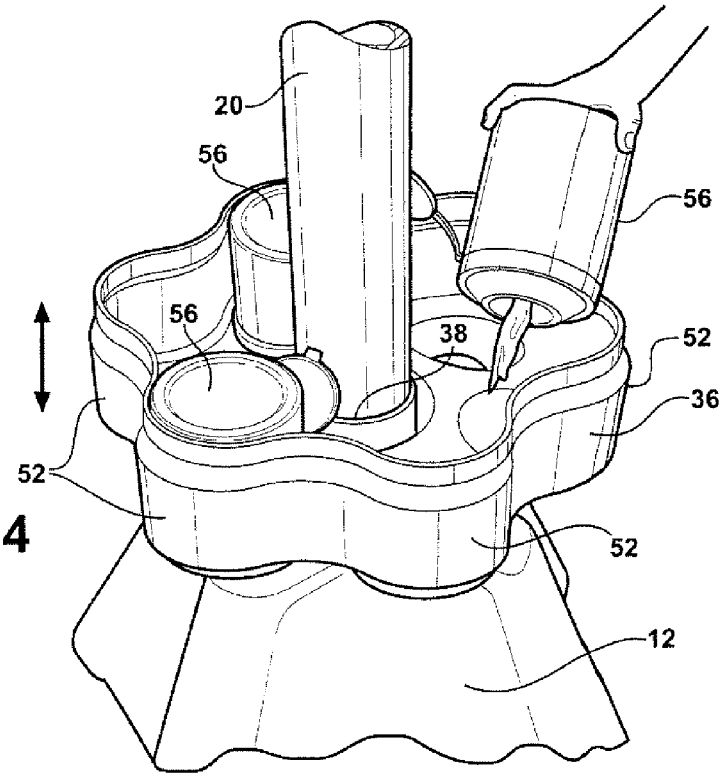
FIG. 4 is an upper perspective view illustrating the dispensing unit of the standalone portable dispenser assembly of the present invention in a configuration suitable for including multiple pre-manufactured hand towel dispensing devices, in a lowered position upon the extension portion of the assembly, for refilling the dispensing unit with hand towel canisters.

As shown in FIGS. 3 and 4, the dispensing unit 36 is slidably disposed upon the extension portion 20 through its central aperture 38 to provide for convenient refilling. In such a slidable configuration, the dispensing unit 36 is considered to also be removably attached to the extension portion, so as to provide a modular assembly for which one or more portions can be conveniently replaced in the event of damage. In the arrangement shown in FIGS. 1-3, the dispensing unit 36 is able to be inserted through a lower opening 40 of the upper cover portion 32 and secured within said upper cover portion 32, such that a majority of the dispensing unit 36 is contained within the upper cover portion 32. As shown in FIGS. 2 and 3, the dispensing unit 36 may be secured in a retained position within the upper cover portion 32 through the use of a pin 42 that is inserted through apertures 44 in the extension portion 20 located upon the dispensing unit 36, and can again be locked through the use of a lock 48, such as a conventional keylock. The pin 42 is also shown to be capable of being disposed within notches 46 on the dispensing unit 36, to inhibit rotation of the dispensing unit with respect to the extension portion 20.

The dispensing unit 36 may accommodate one or more open or hand-operated, replaceable premanufactured or refillable, dispensing devices for dispensing one or more sanitary items, such as dry hand towels, moistened hand towels, liquid hand soaps, liquid antibacterial hand cleansers, shampoos or any other suitable items that can be dispensed by such devices. Any such dispensing device or devices may be attached directly to the exterior surface of, or contained within the interior of, the dispensing unit 36. Where such dispensing devices are desired to be contained within the interior of the dispensing unit 36, the dispensing unit 36 may include one or more configured surfaces 50 and 52 corresponding to an exterior configuration of said at least one dispensing device. Such configured surfaces provide one or more locations for the insertion of suitable dispensing devices, such as premanufactured hand towel canisters, so that they can be retained in a substantially stationary position within the dispensing unit 36 that is convenient for accessing the contents of such dispensing devices. They also assist in protecting the dispensing devices against the weather and against vandalism and theft.

As shown in FIGS. 1-5, the dispensing unit 36 includes a plurality of such configured surfaces 50 and 52 that provide locations for the dispensing unit 36 to accommodate the insertion of a plurality of dispensing devices. Although the dispensing unit 36 is shown to include six such locations for dispensing devices, it will be realized that the dispensing unit 36 may be configured to accommodate any suitable number of dispensing devices without departing from the invention.

In the arrangement where the dispensing unit 36 is designed to be raised upon the extension portion 20 and secured within a lower recess of the upper cover portion 32 or inserted through a lower opening of the upper cover portion 32 and secured substantially within the upper cover portion 32, the upper cover portion 32 may be designed in a configuration to include complementary surfaces 54 that correspond to the configuration of the configured surfaces 52 on the dispensing unit 36. In this way, the dispensing unit 36 may be positioned in a secured condition within the upper cover portion 32.

Figure 5:
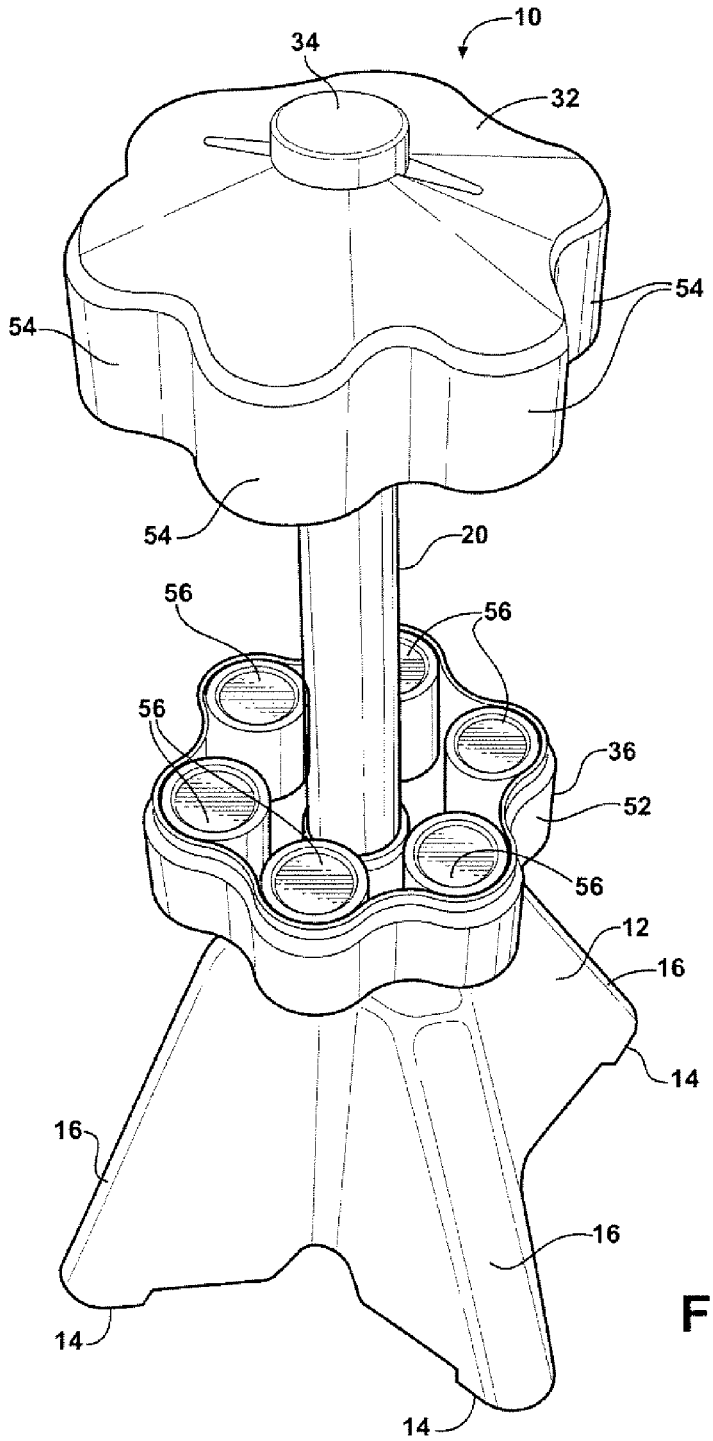
FIG. 5 is an upper perspective view illustrating the standalone portable dispenser assembly of the present invention in a configuration suitable for including multiple pre-manufactured hand towel dispensing devices, with its dispensing unit in a lowered position upon the extension portion of the assembly and in a refilled condition with hand towel canisters.

The loading of the dispensing unit 36 with dispensing devices is shown in FIGS. 4 and 5, where the dispensing unit 36 is in a lowered position near the lower end of the extension portion 20. In this position, the dispensing unit 36 rests upon the base portion 12 in a convenient position for inserting dispensing devices, such as the premanufactured hand towel canisters 56 shown, into the provided locations in dispensing unit 36. Once all available locations within the dispensing unit 36 are filled with dispensing devices, as shown in FIG. 5, the dispensing unit 36 can then be slid upwardly along the extension portion 20 into position relative to the upper cover portion 32 and secured in place, as described above.

Figure 6:
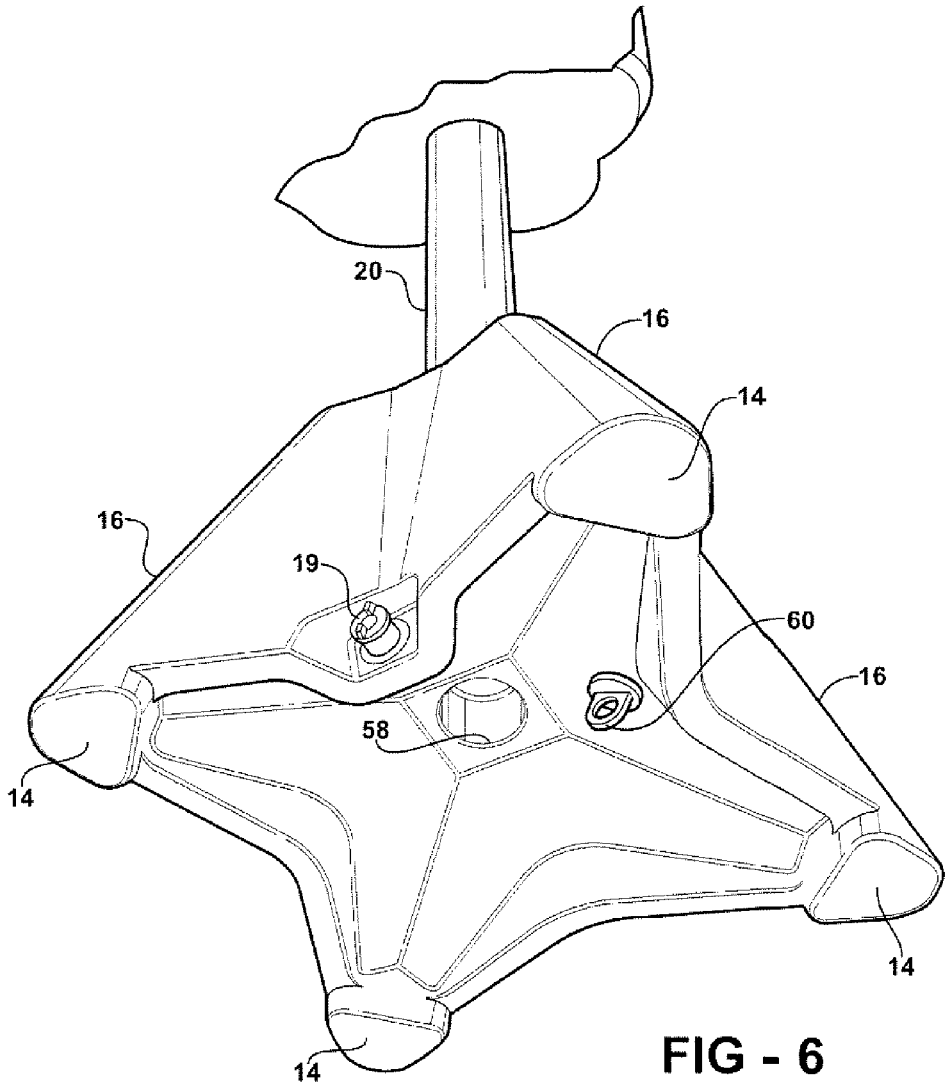
FIG. 6 is a lower perspective view illustrating the underside of the base portion of the standalone portable dispenser assembly of the present invention in a tilted configuration.

FIG. 6 shows a configuration for the underside of the base portion 12. This configuration provides for a portion of the underside to be recessed, so as to spread out the weight of the base portion 12 toward the feet 14. The base portion 12 is also shown to include a cylindrical stub 58 at the central portion of its underside that is sized to engage the lower end of the extension portion 20, for securing the extension portion 20 in a substantially vertical position with respect to the base portion 12. Also, the base portion 12 is shown to include an optional tie-down ring 60 upon which a cable and lock or other locking device may be secured, to prevent theft.

Figure 7:
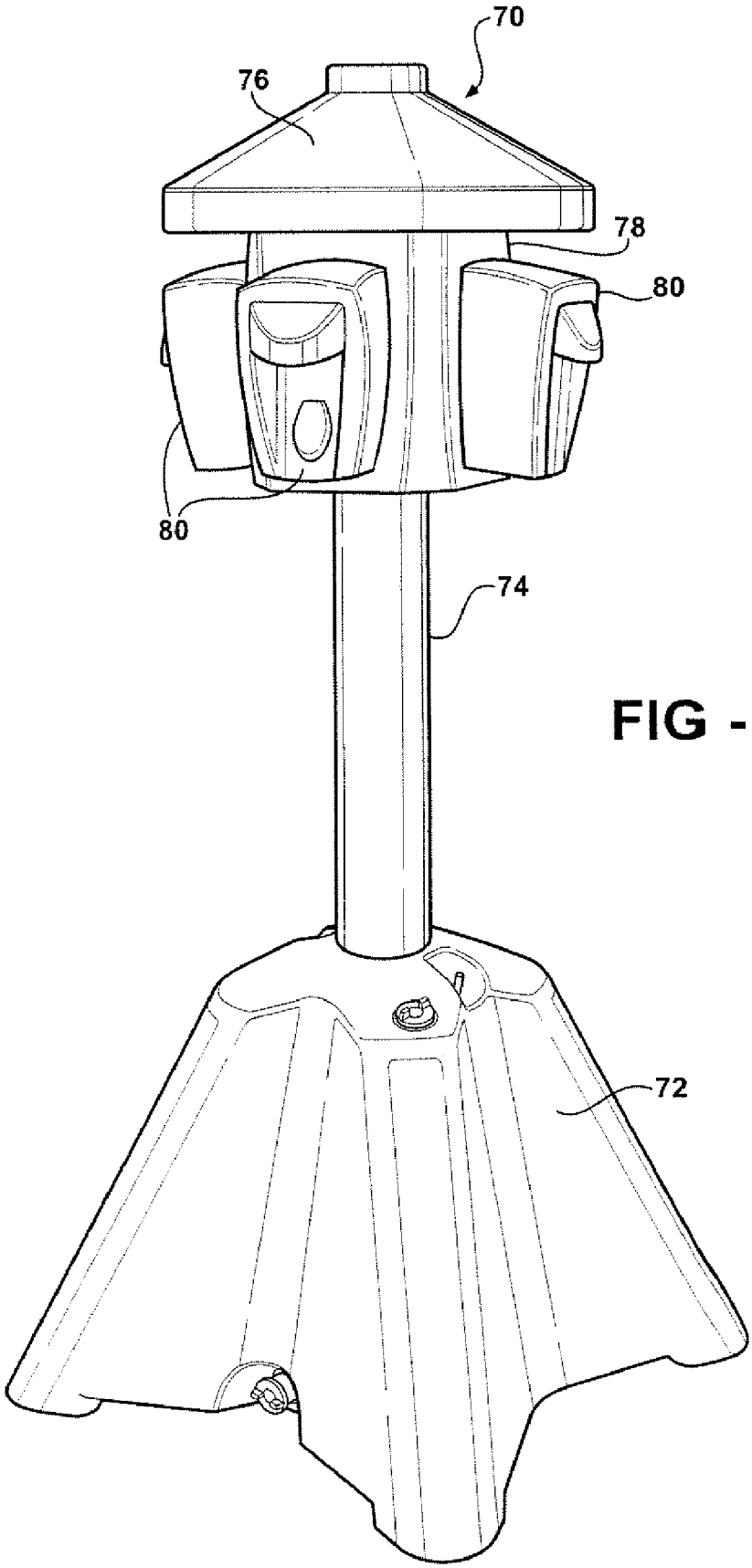
FIG. 7 is a perspective view illustrating the standalone portable dispenser assembly of the present invention, with attached hand soap dispensing devices.

FIG. 7 shows another arrangement of the dispenser assembly of the present invention, generally at 70. Many of the features for this arrangement are the same as described in connection with the previous arrangement, as the dispenser assembly 70 includes a base portion 72, an extension portion 74 and an upper cover portion 76. In this arrangement, however, the dispensing unit 78 is secured to a lower surface of the upper cover portion 76. The dispensing unit 78 provides for the inclusion of one or more dispensing devices, this time in the form of a plurality of refillable liquid hand soap dispensing devices 80 disposed upon the dispensing unit 78. As shown in FIG. 7, four such liquid hand soap dispensing devices 80 are provided, although any suitable number may be used. Also, the liquid hand soap dispensing devices 80 are shown to be located on multiple sides of the dispensing unit 78, so as to be generally accessible from all horizontal directions relative to the dispenser assembly 70.

It will be understood that the foregoing description is provided merely by way of illustration and example, and is not intended to limit the scope of the invention. Accordingly, it will be appreciated that various modifications may be made to the examples provided without departing from the spirit of the invention as claimed.

What is claimed is:

1. A standalone portable dispenser assembly for sanitary items comprising:

a base portion having a lower surface suitable for resting upon the ground or other support surface and having a configuration that provides resistance to the dispenser assembly against being tipped from an upright condition, wherein said base portion includes an internal enclosed space suitable for containing a material selected from the group consisting of water and sand for providing weight to said base portion for further enhancing resistance of the dispenser assembly against being tipped from an upright condition;

an extension portion attached to, and extending upwardly from, the base portion;

an upper cover portion having opposing sides and being attached to the extension portion so as to be maintained in a position above the base portion, said upper cover portion including a horizontally disposed shield portion extending from one side of the cover portion to the opposing side of the cover portion and being operable to provide shielding from weather elements falling from above;

a dispensing unit disposed upon the extension portion so as to be maintained in a position above the base portion and below the upper cover portion, such that at least one sanitary item may be accessed by a user of the assembly from below the upper cover portion, while being at least partially shielded from weather by said upper cover portion; and at least one dispensing device disposed in communication with said dispensing unit, each dispensing device operable for dispensing at least one sanitary item.

2. The standalone portable dispenser assembly according to claim 1, wherein said base portion includes a plurality of leg portions formed as part of the base portion and disposed in an outward direction relative to a central longitudinal axis of said base portion.

3. The standalone portable dispenser assembly according to claim 1, wherein said base portion further includes a removable closure for securing said material for providing weight within said base portion.

4. The standalone portable dispenser assembly according to claim 1, wherein said extension portion is in the configuration of a vertically-disposed hollow cylindrical tube.

5. The standalone portable dispenser assembly according to claim 1, wherein at least one of said base portion, said extension portion and said dispensing unit are constructed from molded plastic.

6. The standalone portable dispenser assembly according to claim 1, wherein said extension portion is removably attached to said base portion and at least one of said upper cover portion and said dispensing unit is removably attached to the extension portion, so as to provide a modular assembly for which one or more portions can be conveniently replaced in the event of damage.

7. The standalone portable dispenser assembly according to claim 1, wherein said sanitary item is selected from the group consisting of dry hand towels, moistened hand towels, liquid hand soaps, liquid antibacterial hand cleansers and shampoos.

8. The standalone portable dispenser assembly according to claim 1, wherein said at least one dispensing device comprises a plurality of dispensing devices.

9. The standalone portable dispenser assembly according to claim 7, wherein said plurality of dispensing devices are disposed upon multiple sides of said dispensing unit, so as to be generally accessible from all horizontal directions relative to said assembly.

10. The standalone portable dispenser assembly according to claim 1, wherein said at least one dispensing device comprises at least one refillable liquid hand soap container, each container having a hand-operated dispensing actuator that releases liquid hand soap when manipulated by a user of the assembly.

11. The standalone portable dispenser assembly according to claim 1, wherein said at least one dispensing device comprises a plurality of refillable liquid hand soap containers, each container having a hand-operated dispensing actuator that releases liquid hand soap when manipulated by a user of the assembly.

12. The standalone portable dispenser assembly according to claim 1, wherein said at least one dispensing device comprises a plurality of hand towel containers, each hand towel container having an opening from which hand towels may be successively acquired.

13. The standalone portable dispenser assembly according to claim 1, wherein said dispensing unit is adapted to be secured to a lower surface of said upper cover portion, such that said at least one sanitary item may be accessed by a user of the assembly from below said upper cover portion.

14. The standalone portable dispenser assembly according to claim 1, wherein said dispensing unit is slidably disposed upon said extension portion and is adapted to be secured to a lower surface of said upper cover portion, such that said at least one sanitary item may be accessed by a user of the assembly from below said upper cover portion.

15. The standalone portable dispenser assembly according to claim 1, wherein said dispensing unit is slidably disposed upon said extension portion and is adapted to be inserted and secured within a lower recess of said upper cover portion, such that said at least one sanitary item may be accessed by a user of the assembly from below said upper cover portion.

16. The standalone portable dispenser assembly according to claim 1, wherein said dispensing unit is slidably disposed upon said extension portion and is adapted to be inserted through a lower opening of said upper cover portion and secured within said upper cover portion, such that a majority of said dispensing unit is contained within said upper cover portion, and such that said at least one sanitary item may be accessed by a user of the assembly from below said upper cover portion.

17. The standalone portable dispenser assembly according to claim 15, wherein said dispensing unit has an external configuration that is complementary to an internal configuration of said lower recess of said upper cover portion.

18. The standalone portable dispenser assembly according to claim 16, wherein said dispensing unit has an external configuration that is complementary to an internal configuration of said upper cover portion.

19. The standalone portable dispenser assembly according to claim 1, wherein said dispensing unit includes at least one configured surface corresponding to an exterior configuration of said at least one dispensing device for providing at least one location within the dispensing unit that is capable of holding said at least one dispensing device within said dispensing unit.

20. The standalone portable dispenser assembly according to claim 1, wherein said dispensing unit includes at least one aperture through which a sanitary item from said at least one dispensing device may be acquired.

21. The standalone portable dispenser assembly according to claim 1, wherein said at least one dispensing device comprises a plurality of liquid hand soap dispensing devices disposed upon multiple sides of said dispensing unit, so as to be generally accessible from all horizontal directions relative to said assembly.

22. The standalone portable dispenser assembly according to claim 1, wherein said at least one dispensing device comprises a plurality of hand towel containers disposed within said dispensing unit on multiple sides of said dispensing unit, so as to be generally accessible from all horizontal directions relative to said assembly.

23. A standalone modular portable dispenser assembly for sanitary items comprising:

a base portion having a lower surface suitable for resting upon the ground or other support surface and having a configuration that provides resistance to the dispenser assembly against being tipped from an upright condition, wherein said base portion includes an internal enclosed space suitable for containing a material selected from the group consisting of water and sand for providing weight to said base portion for further enhancing resistance of the dispenser assembly against being tipped from an upright condition;

an extension portion removably attached to, and extending upwardly from, the base portion;

an upper cover portion having opposing sides and being removably attached to the extension portion so as to be maintained in a position above the base portion, said upper cover portion including a horizontally disposed shield portion extending from one side of the cover portion to the opposing side of the cover portion and being operable to provide shielding from weather elements falling from above;

a dispensing unit disposed upon the extension portion so as to be maintained in a position above the base portion and below the upper cover portion, such that at least one sanitary item may be accessed by a user of the assembly from below the upper cover portion, while being at least partially shielded from weather by said upper cover portion; and at least one dispensing device disposed in communication with said dispensing unit, each dispensing device operable for dispensing at least one sanitary item.

24. A standalone portable dispenser assembly for sanitary items comprising:

a base portion having a lower surface suitable for resting upon the ground or other support surface and having a configuration that provides resistance to the dispenser assembly against being tipped from an upright condition, wherein said base portion includes an internal enclosed space suitable for containing a material selected from the group consisting of water and sand for providing weight to said base portion for further enhancing resistance of the dispenser assembly against being tipped from an upright condition;

an extension portion attached to, and extending upwardly from, the base portion;

an upper cover portion having opposing sides and being attached to the extension portion so as to be maintained in a position above the base portion, said upper cover portion including a horizontally disposed shield portion extending from one side of the cover portion to the opposing side of the cover portion and being operable to provide shielding from weather elements falling from above; and at least one dispensing device disposed in communication with said extension portion at a location below the upper cover portion, each dispensing device operable for dispensing at least one sanitary item, such that at least one sanitary item may be accessed by a user of the assembly from below the upper cover portion while being at least partially shielded from weather by the upper cover portion.

25. The standalone portable dispenser assembly according to claim 24, wherein said extension portion is removably attached to said base portion and at least one of said upper cover portion and said at least one dispensing device is removably attached to the extension portion, so as to provide a modular assembly for which one or more portions can be conveniently replaced in the event of damage.

26. The standalone portable dispenser assembly according to claim 24, wherein said sanitary item is selected from the group consisting of dry hand towels, moistened hand towels, liquid hand soaps, liquid antibacterial hand cleansers and shampoos.

27. The standalone portable dispenser assembly according to claim 24, wherein said at least one dispensing device comprises a plurality of dispensing devices.

* * * * *